US008892349B2

(12) United States Patent
Estkowski et al.

(10) Patent No.: US 8,892,349 B2
(45) Date of Patent: Nov. 18, 2014

(54) AVIATION ADVISORY

(75) Inventors: Regina I. Estkowski, Bellevue, WA (US); Ted D. Whitley, Lopez Island, WA (US); Richard Baumeister, Aurora, CO (US); Neale Leslie Fulton, Kambah (AU)

(73) Assignee: The Boeing Company, Chicago, IL (US)

( * ) Notice: Subject to any disclaimer, the term of this patent is extended or adjusted under 35 U.S.C. 154(b) by 239 days.

(21) Appl. No.: 13/246,070

(22) Filed: Sep. 27, 2011

(65) Prior Publication Data

US 2013/0080042 A1 Mar. 28, 2013

(51) Int. Cl.
*G08G 5/00* (2006.01)

(52) U.S. Cl.
CPC ..... *G08G 5/0026* (2013.01); *G08G 5/0039* (2013.01); *G08G 5/0013* (2013.01); *G08G 5/0052* (2013.01)
USPC ..... 701/301; 701/120; 701/122; 701/528; 701/16; 342/36

(58) Field of Classification Search
CPC ..... G08G 5/0026
USPC ..... 701/120, 122, 301, 528, 16; 342/36
See application file for complete search history.

(56) References Cited

U.S. PATENT DOCUMENTS

| | | | | |
|---|---|---|---|---|
| 6,795,772 | B2 * | 9/2004 | Lin et al. | 701/301 |
| 6,799,087 | B2 | 9/2004 | Estkowski | |
| 6,873,903 | B2 * | 3/2005 | Baiada et al. | 701/120 |
| 6,885,303 | B2 | 4/2005 | Payton et al. | |
| 7,212,917 | B2 | 5/2007 | Wilson | |
| 7,248,949 | B2 * | 7/2007 | Love et al. | 701/4 |
| 7,372,400 | B2 | 5/2008 | Cohen et al. | |
| 7,447,593 | B2 | 11/2008 | Estkowski et al. | |
| 7,457,690 | B2 | 11/2008 | Wilson | |
| 7,468,696 | B2 | 12/2008 | Bornholdt | |
| 7,471,995 | B1 | 12/2008 | Robinson | |
| 7,489,926 | B2 | 2/2009 | Whelan et al. | |
| 7,579,987 | B2 | 8/2009 | Cohen et al. | |
| 8,060,295 | B2 * | 11/2011 | Estkowski et al. | 701/120 |
| 8,140,252 | B2 * | 3/2012 | Wise et al. | 701/120 |
| 8,285,427 | B2 * | 10/2012 | Rogers et al. | 701/3 |
| 8,290,696 | B1 * | 10/2012 | Sridhar et al. | 701/120 |
| 8,380,424 | B2 * | 2/2013 | Bushnell | 701/122 |

(Continued)

OTHER PUBLICATIONS

Extended European Search Report dated Dec. 20, 2013, EP Application No. 12185983.9-1803/2575122, 10 pages.

*Primary Examiner* — Thomas G Black
*Assistant Examiner* — Wae Louie
(74) *Attorney, Agent, or Firm* — Toler Law Group, PC

(57) ABSTRACT

In one embodiment, a method comprises receiving, in a computer-based airspace monitoring system, airspace information from a plurality of different sources via a plurality of different communication networks, receiving, in the computer-based airspace monitoring system, a first flightpath parameter from a first aircraft at a first point in time, wherein the first flightpath parameter comprises at least one of a three-dimensional position parameter, a flight trajectory parameter, or a speed parameter, establishing, in the computer-based airspace monitoring system, a first defined airspace in a region proximate the first aircraft, processing, in the computer-based airspace monitoring system, the airspace information for the first defined airspace based on the first position parameter received from the first aircraft to define a first data set of airspace information relevant to the first aircraft, and transmitting the first dataset of airspace information from the computer-based airspace monitoring system to the first aircraft.

21 Claims, 5 Drawing Sheets

(56) References Cited

U.S. PATENT DOCUMENTS

| | | | | |
|---|---|---|---|---|
| 2002/0115422 | A1 | 8/2002 | Robinson | |
| 2003/0122701 | A1* | 7/2003 | Tran | 342/29 |
| 2003/0176947 | A1 | 9/2003 | Estkowski | |
| 2003/0233211 | A1 | 12/2003 | Payton | |
| 2005/0049762 | A1* | 3/2005 | Dwyer | 701/3 |
| 2005/0187677 | A1* | 8/2005 | Walker | 701/16 |
| 2005/0216181 | A1 | 9/2005 | Estkowski | |
| 2006/0089760 | A1* | 4/2006 | Love et al. | 701/4 |
| 2006/0224318 | A1 | 10/2006 | Wilson | |
| 2007/0150127 | A1* | 6/2007 | Wilson et al. | 701/10 |
| 2007/0162197 | A1 | 7/2007 | Fleming | |
| 2008/0158049 | A1 | 7/2008 | Southard et al. | |
| 2008/0294749 | A1 | 11/2008 | Derenge | |
| 2009/0125221 | A1* | 5/2009 | Estkowski et al. | 701/120 |
| 2010/0030401 | A1* | 2/2010 | Rogers et al. | 701/3 |
| 2010/0174475 | A1* | 7/2010 | Estkowski et al. | 701/120 |
| 2012/0209457 | A1* | 8/2012 | Bushnell | 701/13 |
| 2013/0080042 | A1* | 3/2013 | Estkowski et al. | 701/120 |

* cited by examiner

AVIATION ADVISORY

RELATED APPLICATIONS

None

BACKGROUND

The subject matter described herein relates to aviation communication, and more particularly systems and methods which provide aviation advisory information to general aviation aircraft.

Civil aviation activities may be classified broadly into two categories: scheduled air transport and general aviation. Scheduled air transport commonly refers to passenger and cargo flights which operate on regularly scheduled routes. General aviation activities refer to all other aviation activities including, but not limited to, commercial aviation and private aviation. Military aviation activities refer to the use of aircraft and other flight vehicles for military purposes.

Scheduled air transport activities generally are managed by civil aviation authorities. In the United States, for example, scheduled air transport is managed by the U.S. Air Traffic Control (ATC) system. The current U.S. Air Traffic Control System includes 20 Air Route Traffic Control Centers or "Centers" that are the largest ATC facilities interacting directly with the aircraft. Each Center is responsible for the safety and efficient transit of aircraft through their assigned segment of the airspace. Controllers at the Centers communicate with individual aircraft that are generally at high altitudes or away from major airports. The Terminal Radar Approach Control (TRACON) facilities house controllers that are responsible for the airspace within approximately 40 miles of major airports. Towers are responsible for approaches and departures of aircraft as well as taxiing at a specific airport.

By contrast, general aviation and military aircraft often operate in substantially unregulated airspace and using airports that have no formal air traffic control. In addition, many general aviation aircraft lack radar facilities or formal collision avoidance systems. Accordingly, additional systems and methods to provide aviation advisories to aircraft may find utility.

BRIEF DESCRIPTION OF THE DRAWINGS

The detailed description is described with reference to the accompanying figures.

SUMMARY

Figure 1:
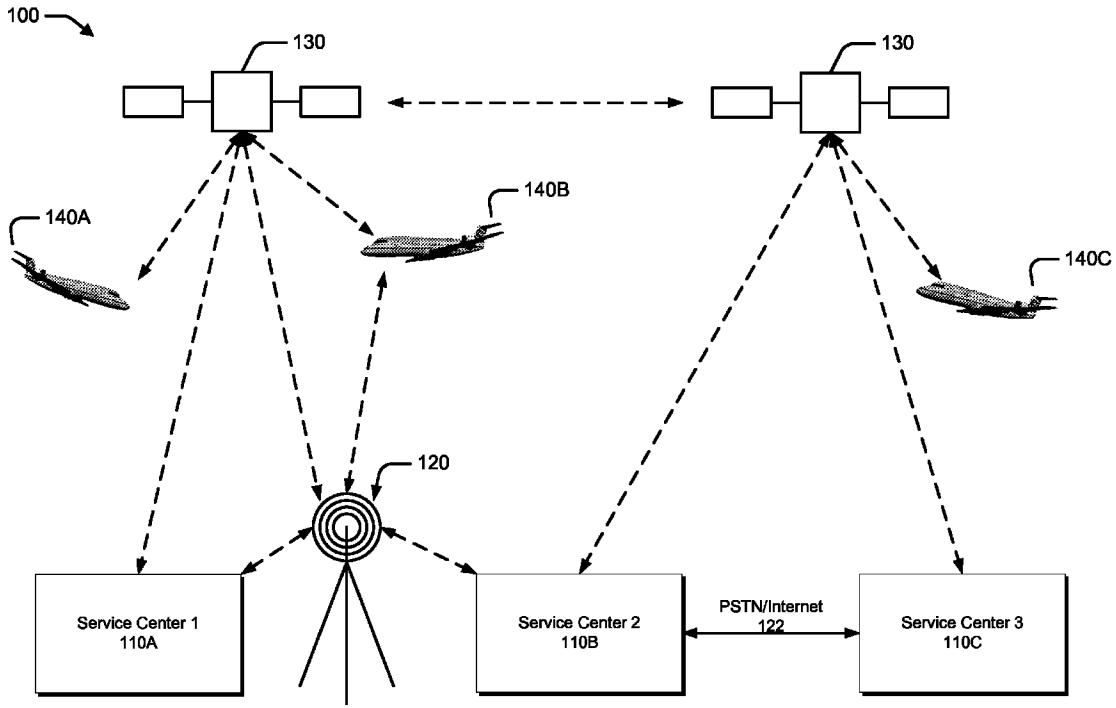
FIG. 1 is a schematic illustration of an environment in which systems and methods to provide aircraft advisories may be implemented, according to embodiments.

Described herein are an apparatus, systems, and methods for aviation advisories. In one embodiment, a method comprises receiving, in a computer-based airspace monitoring system, airspace information from a plurality of different sources via a plurality of different communication networks, receiving, in the computer-based airspace monitoring system, a first flightpath parameter from a first aircraft at a first point in time, wherein the first flightpath parameter comprises at least one of a three-dimensional position parameter, a flight trajectory parameter, or a speed parameter, establishing, in the computer-based airspace monitoring system, a first defined airspace in a region proximate the first aircraft, processing, in the computer-based airspace monitoring system, the airspace information for the first defined airspace based on the first position parameter received from the first aircraft to define a first data set of airspace information relevant to the first aircraft, and transmitting the first dataset of airspace information from the computer-based airspace monitoring system to the first aircraft.

In other embodiments, a computer-based airspace monitoring system, comprises a processor and a plurality of input interfaces to receive airspace information from a plurality of different sources via a plurality of different communication networks and receive a first flightpath parameter from a first aircraft at a first point in time, wherein the first flightpath parameter comprises at least one of a three-dimensional position parameter, a flight trajectory parameter, or a speed parameter. The system further comprises a memory module comprising logic instructions stored in a tangible, computer-readable memory which, when executed by the processor, configure the processor to establish a first defined airspace in a region proximate the first aircraft, and process the airspace information for the first defined airspace based on the first position parameter received from the first aircraft to define a first data set of airspace information relevant to the first aircraft. The system further comprises at least one output interface to transmit the first dataset of airspace information from the computer-based airspace monitoring system to the first aircraft.

In another embodiment a computer program product comprising logic instructions stored on a tangible computer-readable medium which, when executed by a processor, configure the processor to receive airspace information from a plurality of different sources via a plurality of different communication networks, receive a first flightpath parameter from a first aircraft at a first point in time, wherein the first flightpath parameter comprises at least one of a three-dimensional position parameter, a flight trajectory parameter, or a speed parameter, establish a first defined airspace in a region proximate the first aircraft, process the airspace information for the first defined airspace based on the first position parameter received from the first aircraft to define a first data set of airspace information relevant to the first aircraft, and transmit the first dataset of airspace information from the computer-based airspace monitoring system to the first aircraft.

DETAILED DESCRIPTION

In the following description, numerous specific details are set forth to provide a thorough understanding of various embodiments. However, it will be understood by those skilled in the art that the various embodiments may be practiced without the specific details. In other instances, well-known methods, procedures, components, and elements have not been illustrated or described in detail so as not to obscure the particular embodiments.

FIG. 1 is a schematic illustration of an environment 100 in which systems and methods to provide aircraft advisories may be implemented, according to embodiments. Referring to FIG. 1, in some embodiments an environment 100 comprises one or more service centers 110A, 110B, 110C, which may be referred to collectively by reference numeral 110. In some embodiments service centers 110 may be geographically dispersed such that each service center 110 monitors a particular airspace and may be communicatively coupled to one another and to external information sources by one or more communication networks such as a wireless communication network 120, alone or in combination with or a wired networks such as a backbone data network operating over the public switched telephone network (PSTN) or the Internet 112. In other embodiments, individual service centers may monitor particular types of air traffic or be associated with a specific operation, such as military or civil traffic or a disaster area reconnaissance operation.

In addition, service centers 110 may be in communication with one or more satellites 130. In some embodiments the satellites 130 may be embodied as low-earth orbit (LEO) satellites such as those within the Iridium satellite constellation or the Globalstar constellation. Satellite(s) 110 orbit the earth in a known orbit and may transmit one or more spot beams 130 onto the surface of the earth in a known pattern to provide a constant communication connection to land-based communication stations.

One or more aircraft 140*a*, 140*b*, 140*c*, which may be referred to collectively by reference numeral 140, may communicate with service centers 110 via communication links established with the satellites 130 and in some instances with the wireless network 120. In some embodiments aircraft 140 may be embodied as aircraft which fly under a general aviation scheme, as opposed to scheduled air transport. In other embodiments aircraft 140 may be embodied as military aircraft. Because they are not scheduled air transport, aircraft 140 may operate in substantially unregulated airspace and may utilize visual flight rules to manage flight operations.

Figure 2:
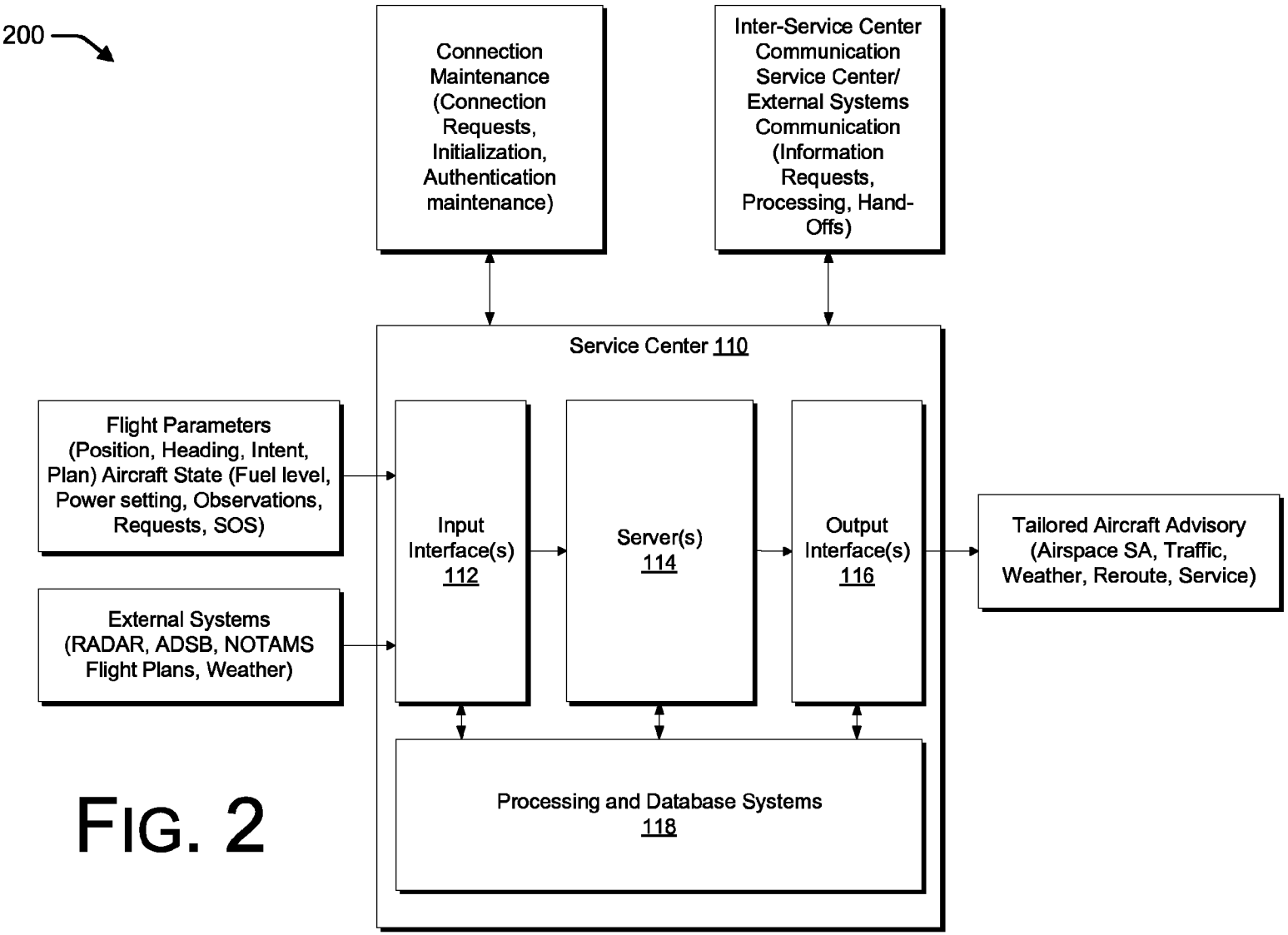
FIG. 2 is a schematic illustration of an aviation advisory system, according to embodiments.

FIG. 2 is a schematic illustration of an aviation advisory system, according to embodiments. Referring to FIG. 2, in some embodiments an aviation advisory system 200 comprises a service center 110, which in turn comprises at least one input interface 112, one or more servers 114, one or more output interfaces 116, and processing and database systems 118. In some embodiments input interface(s) 112 receive airspace information from a plurality of different sources. By way of example, in some embodiments input interface 112 receives flight parameters from aircraft which utilize the aviation advisory system. The flight parameters may include information on the position (i.e., latitude, longitude, altitude), course intent, and flight plan. In addition, flight crew may transmit observations during flight, for example observations about weather, turbulence conditions or the like during flight. Flight crew may also transmit requests for information and distress signals.

Further, input interface(s) 112 may receive airspace information from external systems via servers. By way of example, in some embodiments input interface 112 receives airspace information from one or more RADAR ground-based RADAR systems, traffic and flight information may be received from an Automatic Dependent Surveillance Broadcast (ADSB) system, information from a Notice to Airman (NOTAM) System, flight plans filed for scheduled air transport systems, and information about weather from one or more weather advisory services.

Similarly, one or more output interface(s) 116 provide a communication interface to aircraft which utilize the system 200. The input interface(s) 112 and output interface(s) may provide communication connections via one or more communication networks. By way of example, and not limitation, interface(s) 112 may provide communication connections via a wireless network 120, a satellite network 130, or a ground-based wired network 122.

Input interface(s) 112 are coupled to processing and database systems 118 which process the information received via the input interface(s) 112 to generate aircraft advisories that include information which is tailored for a particular location and flight plan circumstances. In some embodiments processing and database systems 118 may be implemented as computer-based processing units. In some embodiments processing units may be connected to an data base, which may be internal to the service center 110 or external.

Figure 3:
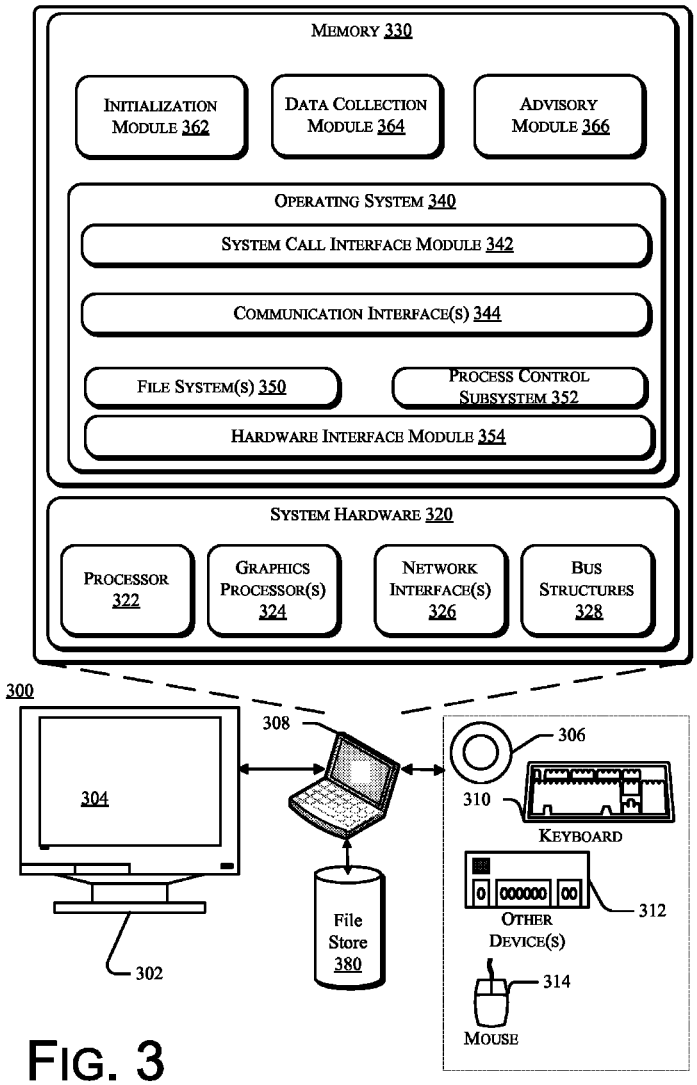
FIG. 3 is a schematic illustration of a computing device which may be adapted to implement an aviation advisory system, according to embodiments.

FIG. 3 is a schematic illustration of a computing system 300 which may be adapted to implement an aviation advisory system, according to embodiments. For example, in the embodiments depicted in FIG. 2 the processing units 114 may be implemented by a computing system as depicted in FIG. 3. Referring to FIG. 3, in one embodiment, system 300 may include a computing device 308 and one or more accompanying input/output devices including a display 302 having a screen 304, one or more speakers 306, a keyboard 310, one or more other I/O device(s) 312, and a mouse 314. The other I/O device(s) 312 may include a touch screen, a voice-activated input device, a track ball, and any other device that allows the system 300 to receive input from a user.

The computing device 308 includes system hardware 320 and memory 330, which may be implemented as random access memory and/or read-only memory. A file store 380 may be communicatively coupled to computing device 308. File store 380 may be internal to computing device 308 such as, e.g., one or more hard drives, CD-ROM drives, DVD-ROM drives, or other types of storage devices. File store 380 may also be external to computer 308 such as, e.g., one or more external hard drives, network attached storage, or a separate storage network.

System hardware 320 may include one or more processors 322, at least two graphics processors 324, network interfaces 326, and bus structures 328. In one embodiment, processor(s) 322 may be embodied as an Intel® Core2 Duo® processor available from Intel Corporation, Santa Clara, Calif., USA. As used herein, the term "processor" means any type of computational element, such as but not limited to, a microprocessor, a microcontroller, a complex instruction set computing (CISC) microprocessor, a reduced instruction set (RISC) microprocessor, a very long instruction word (VLIW) microprocessor, or any other type of processor or processing circuit.

Graphics processors 324 may function as adjunct processors that manage graphics and/or video operations. Graphics processors 324 may be integrated onto the motherboard of computing system 300 or may be coupled via an expansion slot on the motherboard.

In one embodiment, network interface 326 could be a wired interface such as an Ethernet interface (see, e.g., Institute of Electrical and Electronics Engineers/IEEE 802.3-2002) or a wireless interface such as an IEEE 802.11a, b or g-compliant interface (see, e.g., IEEE Standard for IT-Telecommunications and information exchange between systems LAN/MAN—Part II: Wireless LAN Medium Access Control (MAC) and Physical Layer (PHY) specifications Amendment 4: Further Higher Data Rate Extension in the 2.4 GHz Band, 802.11G-2003). Another example of a wireless interface would be a general packet radio service (GPRS) interface (see, e.g., Guidelines on GPRS Handset Requirements, Global System for Mobile Communications/GSM Association, Ver. 3.0.1, December 2002).

Bus structures 328 connect various components of system hardware 128. In one embodiment, bus structures 328 may be one or more of several types of bus structure(s) including a memory bus, a peripheral bus or external bus, and/or a local bus using any variety of available bus architectures including, but not limited to, 11-bit bus, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Universal Serial Bus (USB), Advanced Graphics Port (AGP), Personal Computer Memory Card International Association bus (PCMCIA), and Small Computer Systems Interface (SCSI).

Memory 330 may include an operating system 340 for managing operations of computing device 308. In one embodiment, operating system 340 includes a hardware interface module 354 that provides an interface to system hardware 320. In addition, operating system 340 may include a file system 350 that manages files used in the operation of computing device 308 and a process control subsystem 352 that manages processes executing on computing device 308.

Operating system 340 may include (or manage) one or more communication interfaces that may operate in conjunction with system hardware 120 to transceive data packets and/or data streams from a remote source. Operating system 340 may further include a system call interface module 342 that provides an interface between the operating system 340 and one or more application modules resident in memory 330. Operating system 340 may be embodied as a UNIX operating system or any derivative thereof (e.g., Linux, Solaris, etc.) or as a Windows® brand operating system, or other operating systems.

In various embodiments, the computing device 308 may be embodied as a personal computer, a laptop computer, a personal digital assistant, a mobile telephone, an entertainment device, or another computing device. In other embodiments, the computing device may consist of a collection of processing units, such as a computer cluster or distributed embedded processors.

In one embodiment, memory 330 includes one or more logic modules embodied as logic instructions encoded on a tangible, non transitory memory to impart functionality to the servers 114. The embodiment depicted in FIG. 3 comprises an intialization module 362, a data collection module 364, and an advisory module 366. Additional details about the process and operations implemented by these modules are described with reference to FIGS. 4-5, below.

Figure 4:
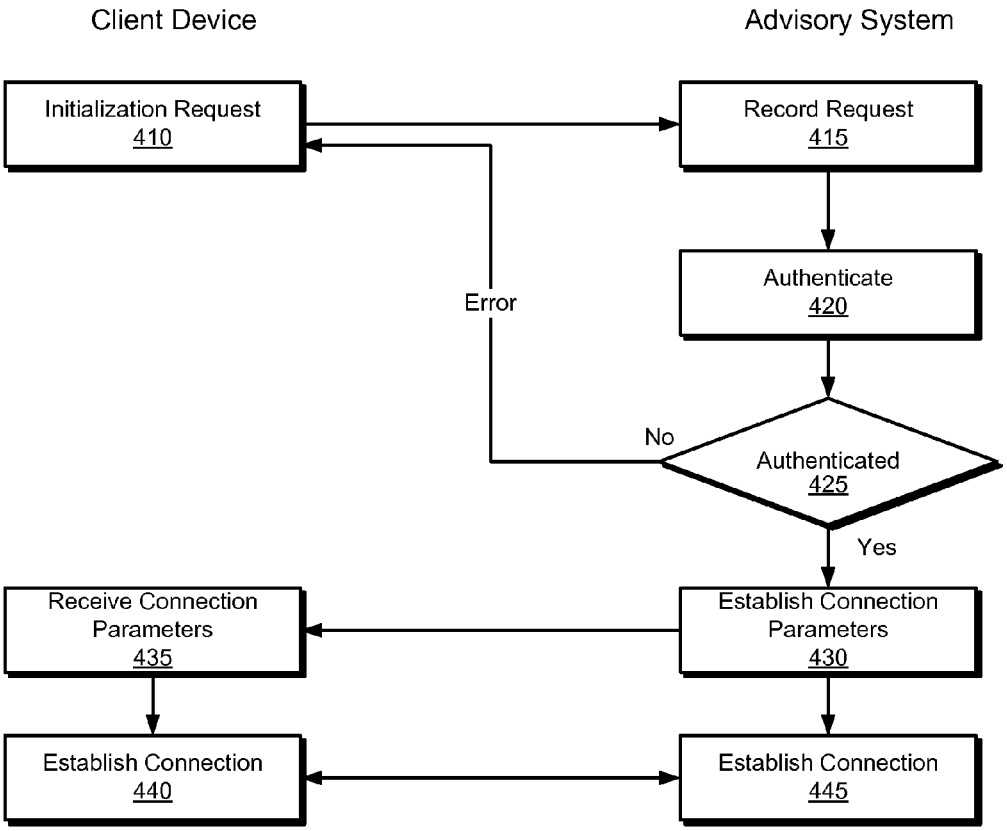
FIG. 4 is a flowchart illustrating operations in a method implemented in an aviation advisory system, according to embodiments.

FIG. 4 is a flowchart illustrating operations in a method implemented in an aviation advisory system, according to embodiments. More particularly, the operations depicted in FIG. 4 may be executed by the initialization module 362 in order to initialize a connection between aviation advisory system 200 and an aircraft. Referring to FIG. 4, at operation 410 a client device generates and transmits an initialization request to the advisory system 200. By way of example and not limitation, client device 120 may include a dedicated device which may be integrated into an aircraft or may be embodied as a general purpose computing device, e.g., a laptop computer, a tablet computer, a mobile telephone or the like. Client device may be communicatively coupled to a satellite navigation system such as, for example, a global positioning system (GPS) module to determine a location based on signals from the global positioning system. Alternatively, or in addition, client device 120 may include logic to determine a location based on signals from one or more LEO or MEO satellites 110 as described in one or more of U.S. Pat. Nos. 7,489,926, 7,372,400, 7,579,987, and 7,468,696, the disclosures of which are incorporated herein by reference in their respective entireties. In some embodiments the location of the client device 120 may be expressed in latitude/longitude coordinates or another earth-based coordinate system and/or altitude above sea level.

At operation 415 the advisory system 200 receives the initialization request from the client device. In some embodiments the advisory system 200 may be available on a subscription basis, such that the client device may be a subscriber to the advisory system 200. In such embodiments, the initialization request may comprise information identifying the client device and/or a user of the client device. At operation 420 the advisory system 200 implements an authentication process to authenticate the client device and/or user of the client device. By way of example, the authentication process may require a user to enter a UserID, alone or in combination with a password, and may require one or more additional authentication steps, e.g. a CAPTCHA test, a geolocation test, or the like.

If, at operation 425 the client device is not authenticated, the advisory system 200 transmits an error message to the client device, which in turn may initiate another initialization request. By contrast, if at operation 425 the client device is authenticated then control passes to operation 430 and the advisory system 200 establishes connection parameters for communication between the advisory system 200 and the client device. By way of example, the advisory system 200 may assign a specific port and a communication protocol to for a communication session with the client device. The connection parameters may be transmitted from advisory system 200 to the client device, which receives the connection parameters (operation 435).

At operations 440 and 445 the client device and the advisory system 200 implement operations to establish a communication connection. By way of example, client device and advisory system 200 may implement a handshake procedure to negotiate communication session protocols between the client device and the advisory system 200.

Figure 5:
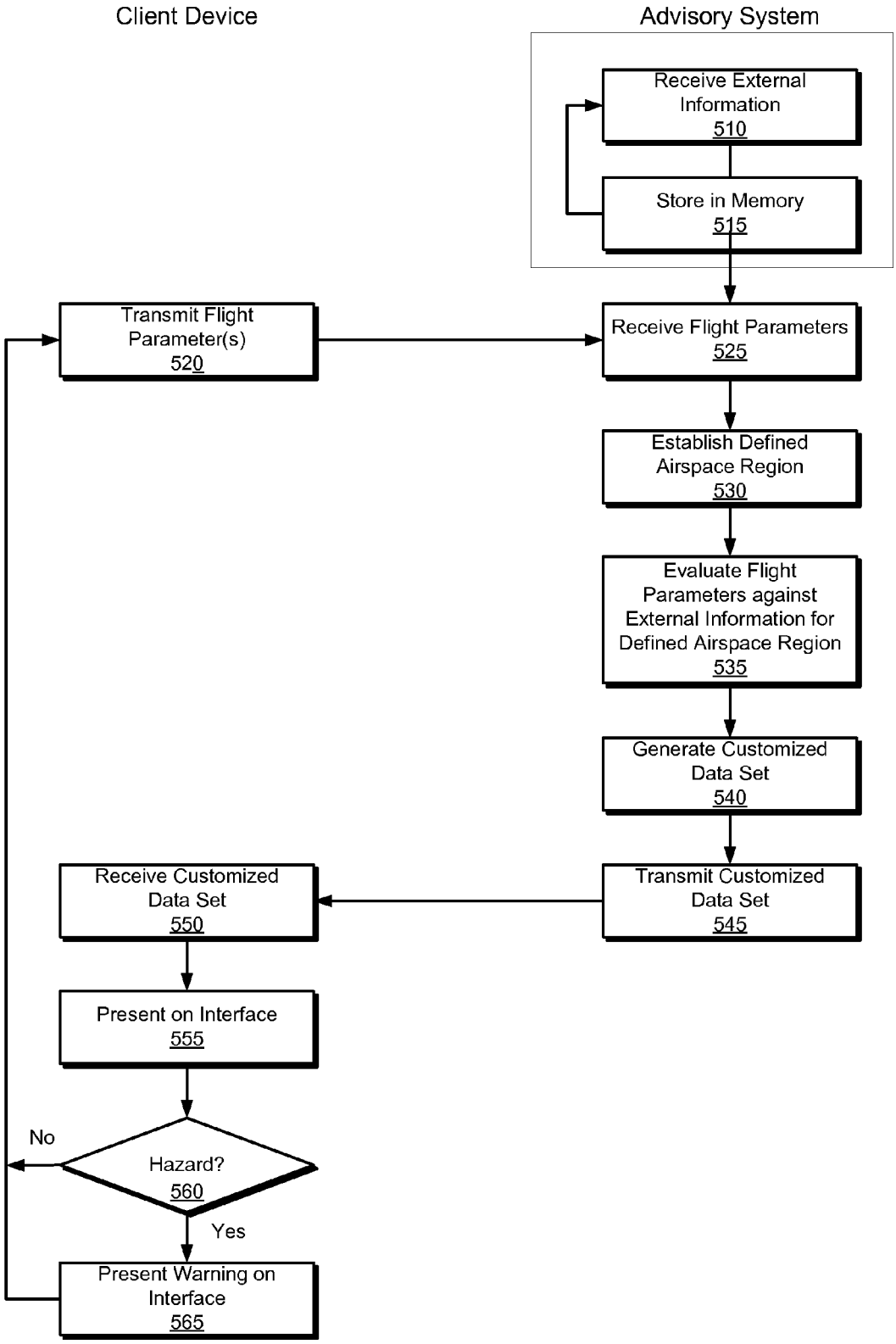
FIG. 5 is a flowchart illustrating operations in a method implemented in an aviation advisory system, according to embodiments.

FIG. 5 is a flowchart illustrating operations in a method implemented in an aviation advisory system, according to embodiments. Referring to FIG. 5, at operation 510 the advisory system receives information from one or more external sources, as described above with reference to FIG. 2. At operation 515 the information is stored in a memory module coupled to the advisory system 200. By way of example, in some embodiments information may be stored in a database or other structured memory device in a file store 380 coupled to advisory system 200.

In some embodiments operations 510-515 may be implemented continuously by data collection module 364. The data collection module 364 may operate substantially continuously and independently to collect data from external sources and flight parameters from aircraft who subscribe to the aviation system 200.

At operation 520 a client device aboard an aircraft may transmit one or more flight parameters to the advisory system 200, as described above with reference to FIG. 2. At operation 525 the advisory system 200 receives the flight parameters from the aircraft, and at operation 530 the advisory system 200 establishes a defined airspace region proximate the aircraft. In some embodiments the defined airspace region may correspond to a region of airspace which may be reached by the aircraft within a specified time limit, as disclosed is commonly assigned U.S. Pat. No. 7,212,917 to Wilson, et al., entitled Tracking, Relay, and Control Information Flow Analysis Process for Information-Based Systems, the disclosure of which is incorporated herein by reference in its entirety.

At operation 535 the advisory system 200 evaluates the flight parameters received from the aircraft against the airspace information received for the airspace region defined in operation 530. In some embodiments the advisory system 200 evaluates the airspace information received in the advisory system 200 for the defined airspace against the flight trajectory for the aircraft, and at operation 540 the advisory system 200 generates a customized data set of airspace information relevant to the first aircraft. By way of example, the data set may comprise location and trajectory information for other aircraft in the defined airspace region, general air traffic information, information about weather hazards in the defined airspace region, suggestions for rerouting a course through the defined airspace region, or other information relevant to safely charting a course through the defined airspace region. The data set is transmitted to the aircraft at operation 545.

At operation 550 the client device on the aircraft receives the data set, and at operation 555 information extracted from the data set may be presented on a user interface. By way of example, in some embodiments information from the data set may be presented on a graphical user interface associated with a map of the defined airspace, such that flight crew of the aircraft are presented with a graphic depiction of relevant information in the defined airspace.

At operation 560 the client device determines whether the airspace information for the defined airspace presents a threat or hazard to the aircraft. By way of example, if at operation 560 the current course of the aircraft presents a risk of collision with another aircraft or obstacle in the airspace or puts the aircraft on course to encounter severe weather, then a hazard warning may be generated and presented on the user interface (operation 565). In addition, evasive measures may be implemented, e.g., by providing a revised flight trajectory for the aircraft.

Operations 520-565 may define a loop which executes on a periodic basis such that the client device associated with an aircraft updates the advisory system 200 periodically with position information, and in response the advisory system 200 periodically establishes a new defined airspace relative to the position of the aircraft, and evaluates the received flight parameters against threats in the defined airspace.

Thus, the system architecture depicted in FIGS. 1-3 and the method depicted in FIGS. 4-5 enable advisory system 200 to monitor airspace and to generate and provide a timely, customized packet of airspace data to a client device on a periodic basis, thereby providing flight crew with improved situational awareness of the airspace in which their aircraft is operating at any point in time. One skilled in the art will recognize that the advisory system may be used in conjunction with hundreds, or even thousands, of aircraft, such that a defined airspace region is associated with and defined by the particular flight characteristics of each aircraft.

The terms "logic instructions" as referred to herein relates to expressions which may be understood by one or more machines for performing one or more logical operations. For example, logic instructions may comprise instructions which are interpretable by a processor compiler for executing one or more operations on one or more data objects. However, this is merely an example of machine-readable instructions and embodiments are not limited in this respect.

The terms "computer readable medium" as referred to herein relates to media capable of maintaining expressions which are perceivable by one or more machines. For example, a computer readable medium may comprise one or more storage devices for storing computer readable instructions or data. Such storage devices may comprise storage media such as, for example, optical, magnetic or semiconductor storage media. However, this is merely an example of a computer readable medium and embodiments are not limited in this respect.

The term "logic" as referred to herein relates to structure for performing one or more logical operations. For example, logic may comprise circuitry which provides one or more output signals based upon one or more input signals. Such circuitry may comprise a finite state machine which receives a digital input and provides a digital output, or circuitry which provides one or more analog output signals in response to one or more analog input signals. Such circuitry may be provided in an application specific integrated circuit (ASIC) or field programmable gate array (FPGA). Also, logic may comprise machine-readable instructions stored in a memory in combination with processing circuitry to execute such machine-readable instructions. However, these are merely examples of structures which may provide logic and embodiments are not limited in this respect.

Various functional components of the system 200 may be implemented as logic instructions which may be executed on a general purpose processor or on a configurable controller. By way of example, in some embodiments initialization module 362, the data collection module 364, and the advisory module 366 may be implemented either as logic or as logic instructions. When executed on a processor, the logic instructions cause a processor to be programmed as a special-purpose machine that implements the described methods. The processor, when configured by the logic instructions to execute the methods described herein, constitutes structure for performing the described methods. Alternatively, the methods described herein may be reduced to logic on, e.g., a field programmable gate array (FPGA), an application specific integrated circuit (ASIC) or the like.

For example, in some embodiments a computer program product may comprise logic instructions stored on a computer-readable medium which, when executed, configure a flight control electronics to detect whether a system management memory module is in a visible state, in response to a determination that system management memory is in a visible state, direct one or more system management memory input/output operations to a system management memory module, and in response to a determination that system management memory is in an invisible state, direct system management memory cache write back operations to the system management memory module and direct other system management memory input/output operations to another location in a system memory.

In the description and claims, the terms coupled and connected, along with their derivatives, may be used. In particular embodiments, connected may be used to indicate that two or more elements are in direct physical or electrical contact with each other. Coupled may mean that two or more elements are in direct physical or electrical contact. However, coupled may also mean that two or more elements may not be in direct contact with each other, but yet may still cooperate or interact with each other.

Reference in the specification to "one embodiment" or "some embodiments" means that a particular feature, structure, or characteristic described in connection with the embodiment is included in at least an implementation. The appearances of the phrase "in one embodiment" in various places in the specification may or may not be all referring to the same embodiment. In the foregoing discussion, specific implementations of exemplary processes have been described, however, it should be understood that in alternate implementations, certain acts need not be performed in the order described above. In alternate embodiments, some acts may be modified, performed in a different order, or may be omitted entirely, depending on the circumstances. Moreover, in various alternate implementations, the acts described may be implemented by a computer, flight control electronics, processor, programmable device, firmware, or any other suitable device, and may be based on instructions stored on one or more computer-readable media or otherwise stored or programmed into such devices (e.g. including transmitting computer-readable instructions in real time to such devices). In the context of software, the acts described above may represent computer instructions that, when executed by one or more processors, perform the recited operations. In the event that computer-readable media are used, the computer-readable media can be any available media that can be accessed by a device to implement the instructions stored thereon.

While various embodiments have been described, those skilled in the art will recognize modifications or variations which might be made without departing from the present disclosure. The examples illustrate the various embodiments and are not intended to limit the present disclosure. Therefore, the description and claims should be interpreted liberally with only such limitation as is necessary in view of the pertinent prior art.

What is claimed is:

1. A method, comprising:

receiving, in a computer-based airspace monitoring service center system, airspace information from a plurality of different sources via a plurality of different communication networks;

receiving, in the computer-based airspace monitoring service center system, a transmission from a first aircraft, wherein the transmission includes data defining at least one first flightpath parameter from the first aircraft, wherein the at least one first flightpath parameter comprises at least one of a three dimensional position parameter, a flight trajectory parameter, or a speed parameter;

establishing, in the computer-based airspace monitoring service center system, a first defined airspace in a region proximate the first aircraft;

processing, in the computer-based airspace monitoring service center system, the airspace information for the first defined airspace based on the at least one first flightpath parameter received from the first aircraft to define a first data set of airspace information relevant to the first aircraft, wherein the first data set of airspace information includes a location of a second aircraft; and transmitting the first data set of airspace information from the computer-based airspace monitoring service center system to the first aircraft, wherein the computer-based airspace monitoring service center system is remote from the first aircraft.

2. The method of claim 1, wherein the airspace information includes at least one of weather information, flight tracking information, surface map information, proximity information, radar information, NOTAM alert information, or flight plan information.

3. The method of claim 1, wherein establishing the first defined airspace in the region proximate the first aircraft comprises defining an airspace which will be reached by the first aircraft within a predetermined time period based on the at least one first flight path parameter.

4. The method of claim 1, wherein processing the airspace information for the first defined airspace based on the at least one first flightpath parameter received from the first aircraft to define the first data set of airspace information relevant to the first aircraft comprises:

evaluating the at least one first flightpath parameter for the first aircraft against the airspace information for the first defined airspace; and including in the first data set of airspace information relevant to the first aircraft a subset of airspace information that is relevant to the at least one first flightpath parameter.

5. The method of claim 1, further comprising:

performing an authentication process based on user information received from the first aircraft;

transmitting an error message in response to the user information failing the authentication process; and establishing a communication connection with the first aircraft in response to the user information passing the authentication process, wherein the at least one first flightpath parameter is received via the communication connection.

6. The method of claim 1, wherein the first aircraft includes an alert module, wherein the alert module is configured to:

generate a warning in response to information in the first data set of airspace information that indicates a potentially dangerous situation; and present the warning on a user interface.

7. The method of claim 1, wherein the computer-based airspace monitoring service center system is a computer system service center that monitors a defined airspace.

8. The method of claim 1, wherein the first aircraft is a subscriber to the computer-based airspace monitoring service center system.

9. An airspace monitoring service center computer system, comprising:

a processor;

at least one input interface to:

receive airspace information from a plurality of different sources via a plurality of different communication networks;

receive at least one first flightpath parameter from a first aircraft, wherein the at least one first flightpath parameter comprises at least one of-a three dimensional position parameter, a flight trajectory parameter, or a speed parameter;

a memory module comprising instructions stored in a tangible, computer-readable memory which, when executed by the processor, cause the processor to:

establish a first defined airspace in a region proximate the first aircraft;

process the airspace information for the first defined airspace based on the at least one first flightpath parameter received from the first aircraft to define a first data set of airspace information relevant to the first aircraft, wherein the first data set of airspace information includes a location of a second aircraft; and at least one wireless communication interface to wirelessly transmit the first data set of airspace information from the airspace monitoring service center computer system to the first aircraft, wherein the at least one wireless communication interface is remote from the first aircraft.

10. The airspace monitoring service center computer system of claim 9, wherein the airspace information includes at least one of weather information, flight tracking information, surface map information, proximity information, radar information, NOTAM alert information, or flight plan information.

11. The airspace monitoring service center computer system of claim 9, wherein the instructions further cause the processor to define an airspace which may be reached by the first aircraft within a predetermined time period.

12. The airspace monitoring service center computer system of claim 9, wherein the instructions further cause the processor to:

evaluate the at least one first flightpath parameter for the first aircraft against the airspace information for the first defined airspace; and include in the first data set of airspace information relevant to the first aircraft a subset of airspace information that is relevant to the at least one first flightpath parameter.

13. The airspace monitoring service center computer system of claim 9, wherein the first aircraft includes an alert module, wherein the alert module is configured to:

generate a warning in response to information in the first data set of airspace information that indicates a potentially dangerous situation; and present the warning on a user interface.

14. The airspace monitoring service center computer system of claim 9, wherein the plurality of different communication networks includes a backbone data network over a public switched telephone network.

15. The airspace monitoring service center computer system of claim 9, wherein:

the at least one input interface is configured to receive from the first aircraft at least one second position parameter, wherein the at least one second position parameter comprises at least one of a second three-dimensional position parameter, a second flight trajectory parameter, or a second speed parameter;

the instructions further cause the processor to:

establish a second defined airspace in a second region proximate the first aircraft;

process the airspace information for the second defined airspace based on the at least one second position parameter received from the first aircraft to define a second data set of airspace information relevant to the first aircraft; and the at least one wireless communication interface is configured to transmit the second data set of airspace information to the first aircraft.

16. The airspace monitoring service center computer system of claim 9, wherein:

the at least one input interface is configured to receive at least one second flightpath parameter from the second aircraft, wherein the second flightpath parameter comprises at least one of a second three-dimensional position parameter, a second flight trajectory parameter, or a second speed parameter;

the instructions further cause the processor to:

establish, in the airspace monitoring service center computer system, the first defined airspace in a second region proximate the second aircraft;

process, in the airspace monitoring service center computer system, the airspace information for the first defined airspace based on the at least one second flightpath parameter received from the second aircraft to define a second data set of airspace information relevant to the second aircraft; and the at least one wireless communication interface is configured to transmit the second data set of airspace information to the second aircraft.

17. A computer program product comprising instructions stored on a tangible computer-readable medium which, when executed by a processor, cause the processor to:

receive airspace information from a plurality of different sources via a plurality of different communication networks;

receive at least one first flightpath parameter via a transmission from a first aircraft, wherein the at least one first flightpath parameter comprises at least one of a three dimensional position parameter, a flight trajectory parameter, or a speed parameter;

establish a first defined airspace in a region proximate the first aircraft;

process the airspace information for the first defined airspace based on the at least one flightpath parameter received from the first aircraft to define a first data set of airspace information relevant to the first aircraft, wherein the first data set of airspace information includes a location of a second aircraft; and transmit the first data set of airspace information from a computer-based airspace monitoring service center system to the first aircraft, wherein the computer-based airspace monitoring service center system is remote from the first aircraft.

18. The computer program product of claim 17, wherein the instructions further cause the processor to define an airspace which may be reached by the first aircraft within a predetermined time period.

19. The computer program product of claim 17, wherein the instructions further cause the processor to:

evaluate the at least one first flightpath parameter for the first aircraft against the airspace information for the first defined airspace; and include in the first data set of airspace information relevant to the first aircraft a subset of airspace information that is relevant to the at least one first flightpath parameter.

20. The computer program product of claim 17, wherein the instructions further cause the processor to:

receive from the first aircraft at least one second position parameter from the first aircraft, wherein the at least one second position parameter comprises at least one of a second three-dimensional position parameter, a second flight trajectory parameter, or a second speed parameter;

establish a second defined airspace in a second region proximate the first aircraft;

process the airspace information for the second defined airspace based on the at least one second position parameter received from the first aircraft to define a second data set of airspace information relevant to the first aircraft; and transmit the second data set of airspace information from the computer-based airspace monitoring service center system to the first aircraft.

21. The computer program product of claim 17, wherein the instructions further cause the processor to:

receive at least one second flightpath parameter from the second aircraft, wherein the at least one second flightpath parameter comprises at least one of a second three-dimensional position parameter, a second flight trajectory parameter, or a second speed parameter;

establish a second defined airspace in a second region proximate the second aircraft;

process the airspace information for the second defined airspace based on the at least one second flightpath parameter received from the second aircraft to define a second data set of airspace information relevant to the second aircraft; and transmit the second data set of airspace information from the computer-based airspace monitoring service center system to the second aircraft.

* * * * *